US006648327B1

(12) United States Patent
Lin

(10) Patent No.: US 6,648,327 B1
(45) Date of Patent: Nov. 18, 2003

(54) DEVICE FOR DETECTING A PLACEMENT POSITION OF A DOCUMENT

(75) Inventor: Chin-Yuan Lin, Taichung (TW)

(73) Assignee: Avision Inc., Hsin Chu (TW)

( * ) Notice: Subject to any disclaimer, the term of this patent is extended or adjusted under 35 U.S.C. 154(b) by 0 days.

(21) Appl. No.: 10/189,442

(22) Filed: Jul. 8, 2002

(30) Foreign Application Priority Data

Dec. 31, 2001 (TW) ..... 90224859 U

(51) Int. Cl.[7] ..... B65H 7/02

(52) U.S. Cl. ..... 271/265.02; 271/261; 271/171; 271/258.01; 271/265.01; 271/259

(58) Field of Search ..... 271/261, 171, 271/259, 258.01, 265, 265.02; 400/642, 601

(56) References Cited

U.S. PATENT DOCUMENTS 4,714,243 A * 12/1987 Staniszewski ..... 271/171
4,738,442 A * 4/1988 Rodi et al. ..... 271/261
4,874,160 A * 10/1989 Yamamoto ..... 271/227
5,215,303 A * 6/1993 Yamada et al. ..... 271/240
5,379,998 A * 1/1995 Nakagawa ..... 271/248
5,411,248 A * 5/1995 Yamaguchi ..... 271/171
5,510,909 A * 4/1996 Morikawa et al. ..... 358/498
5,927,702 A * 7/1999 Ishii et al. ..... 271/9.09
6,164,639 A * 12/2000 Toh et al. ..... 271/171
2003/0001331 A1 * 1/2003 Shyu ..... 271/171

FOREIGN PATENT DOCUMENTS

JP 05178469 A * 7/1993 ..... B65H/1/00

* cited by examiner

*Primary Examiner*—Donald P. Walsh
*Assistant Examiner*—Matthew J. Kohner
(74) *Attorney, Agent, or Firm*—Charles E. Baxley

(57) ABSTRACT

A device for detecting a placement position of a document includes at least two sensors mounted on a document feeding device. Each of the sensors is in parallel with the tangential direction of the leading edge of a document feeding roller, and may be moved by the document feeding device to adjust the placing document width. Thus, the document has to trigger all of the sensors so as to drive the document feeding roller, thereby ensuring that the document may be placed in the document feeding device without tilting, and may have a correct document feeding angle

6 Claims, 7 Drawing Sheets

DEVICE FOR DETECTING A PLACEMENT POSITION OF A DOCUMENT

BACKGROUND OF THE INVENTION

1. Field of the Invention

The present invention relates to a device for detecting a placement position of a document, and more particularly to a method for detecting if the document is placed in a tilting manner, and a device that may perform the above-mentioned detection method and may let the document be fed at a correct document feeding angle.

2. Description of the Related Art

A conventional document feeder in accordance with the prior art is provided with a document guide plate, and a fixed sensor (microswitch). Thus, after the document is placed on the document guide plate, and enters the document feeder, the sensor may be triggered, to drive a document feeding roller to feed the document.

The document guide plate of the above-mentioned device is provided with two movable racks that may be moved relative to each other. The document is placed between the two movable racks. Thus, before use, it is necessary to adjust the relative distance between the two movable racks, thereby facilitating placing the document and correcting the angle of the document.

In the practical use, the user usually first place the document between the two movable racks, and then adjust the relative distance between the two movable racks. At this time, the document may be placed in a tilting manner, and may trigger the sensor at the fixed position, so that the document feeding roller is rotated to feed the document. Thus, for the scanning device, the scanning device will scan an d obtain a tilting image, or the document is jammed, thereby breaking the original document.

SUMMARY OF THE INVENTION

The present invention is to provide a method for detecting a placement position of a document. The purpose is in that, the automatic document feeding action is performed only after detecting the document is exactly placed at a correct angle.

The present invention is to provide a device for detecting a placement position of a document. The purpose is to efficiently perform detection of placement of the document, thereby preventing the document from being fed in a tilting manner.

The principle of design of the present invention is in that, the sensor for detecting if the document is placed may change its position according to variation of the placing document width, thereby correctly detecting the placing angle of the document.

In accordance with the objective of the present invention, one embodiment of the present invention is a method for detecting a placement position of a document, for detecting if the document is placed in the document feeding device in a tilting manner, and for driving the document feeding action. The detection method includes the following steps:

- a placing step, for placing the document into the document feeding device;
- an adjusting step, for adjusting the document placement width of the document feeding device to correspond to the document width;
- a triggering step, for triggering the at least two sensors of the document feeding device by the document; and

- a document feeding step, for driving the document feeding roller on the document feeding device after all of the sensors are exactly triggered in the triggering step, so as to feed the document automatically.

In accordance with the objective of the present invention, one embodiment of the present invention is a device for detecting a placement position of a document, including:

- a document feeder,
- a document guide plate, mounted on one side of the document feeder, and having two movable racks that are capable of moving relative to each other;
- a document feeding roller, mounted on the document feeder, and having a leading edge located adjacent to one side of the document guide plate; and
- at least two sensors, each respectively connected to each of the two movable racks of the document guide plate, and each of the sensors being in parallel with the tangential direction of the leading edge of the document feeding roller.

Thus, after the document is placed in the document feeding device, the document may be fed only when all of the sensors are driven. Thus, the document may be fed along the correct angle, thereby obtaining a better scanning quality.

Further benefits and advantages of the present invention will become apparent after a careful reading of the detailed description with appropriate reference to the accompanying drawings.

DETAILED DESCRIPTION OF THE PREFERRED EMBODIMENT OF THE INVENTION

A method in accordance with a preferred embodiment of the present invention is primarily to detect if a document is placed in a tilted manner when the document is placed in a document feeding device, so as to perform an automatic document feeding action accordingly. The document feeding device is provided with at least two sensors.

Figure 1:
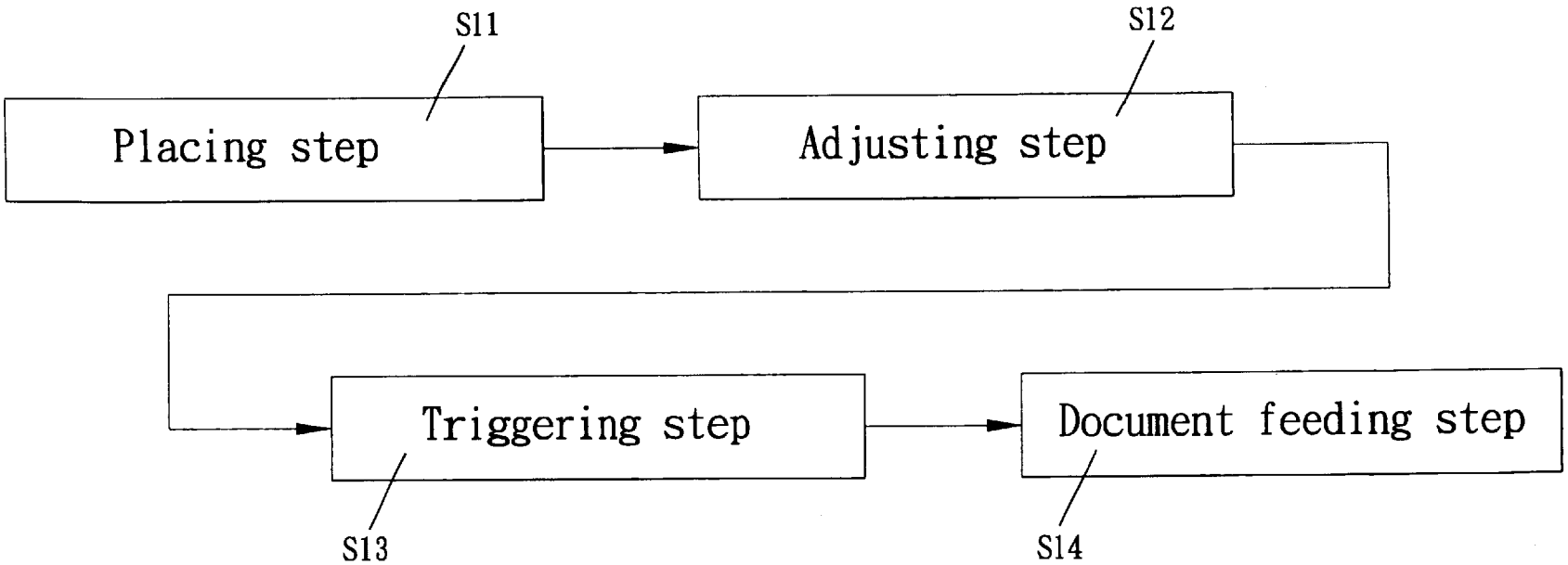
FIG. 1 is a flow chart of a detection method in accordance with a preferred embodiment of the present invention.

FIG. 1 is a flow chart of a detection method in accordance with a preferred embodiment of the present invention.

The detection method in accordance with the preferred embodiment of the present invention includes the following steps:

Step S11: a placing step, for placing the document into the document feeding device;

Step S12: an adjusting step, for adjusting the document placement width of the document feeding device to correspond to the document width;

Step S13: a triggering step, for triggering the at least two sensors of the document feeding device by the document;

The above-mentioned triggering action is to trigger, or to drive, or to cancel the detection action of the at least two sensors of the document feeding device; and Step S14: a document feeding step, for driving the document feeding roller on the document feeding device after all of the sensors are exactly triggered in the triggering step, so as to feed the document automatically.

In the triggering step, it is necessary to trigger at least two sensors. Especially, when the distance between the two sensors is equal to the document width, once both of the two sensors are triggered, the document is disposed at the correct angle.

Of course, the distance between the at least two sensors has to be adjustable with respect to the different document widths, so that the method of the present invention may be available for documents of different widths.

Figure 2:
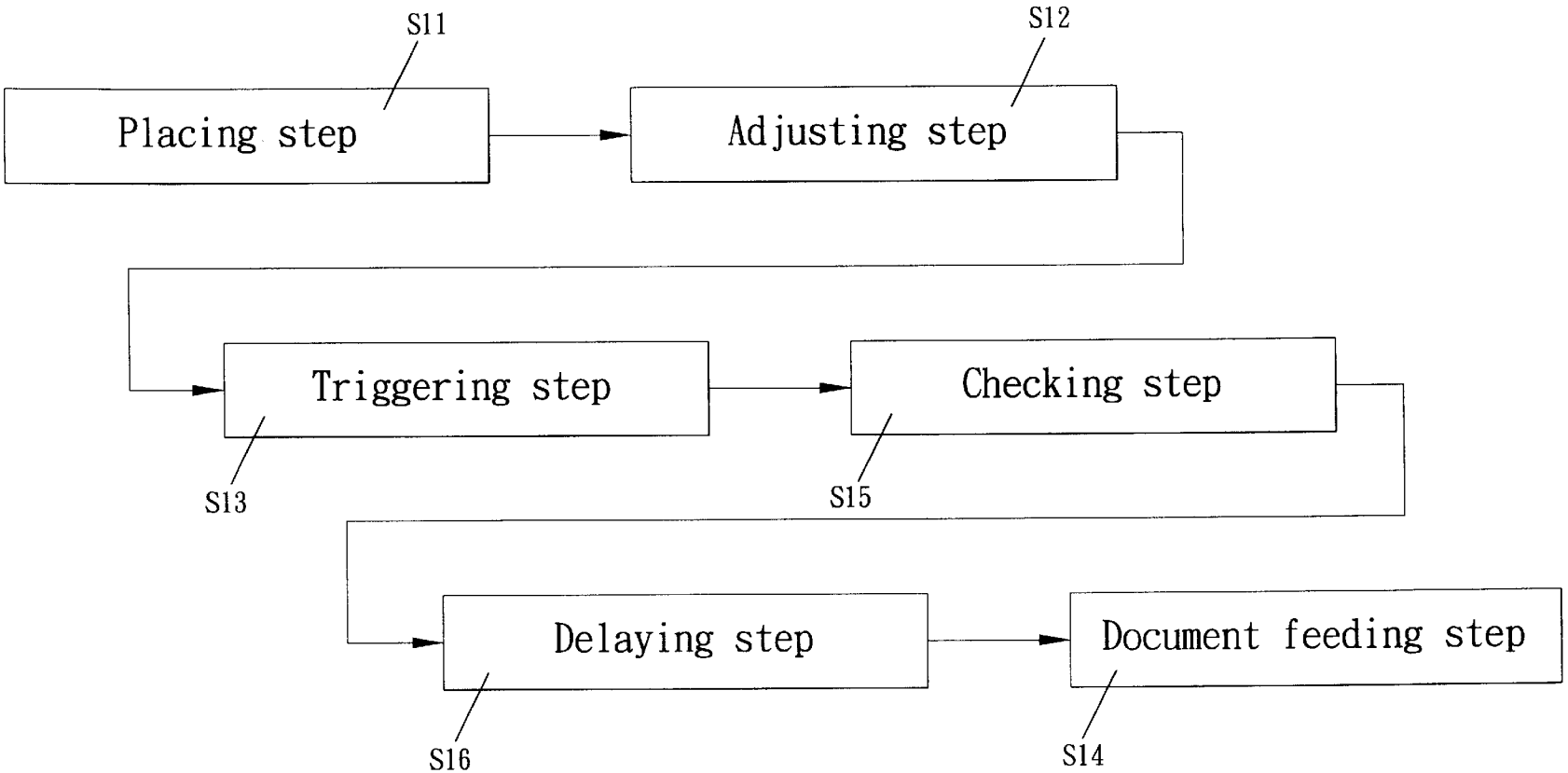
FIG. 2 is a flow chart of another detection method in accordance with a preferred embodiment of the present invention.

FIG. 2 is a flow chart of another detection method in accordance with a preferred embodiment of the present invention. The method as shown in FIG. 2 includes all of the steps of the method as shown in FIG. 1. The difference between the method as shown in FIG. 2 and the method as shown in FIG. 1 is in that, steps S15 and S16 are inserted between steps S13 and S14.

The step S15 is a checking step, for checking if all of the sensors are exactly triggered in the triggering step S13.

The step S16 is a delaying step, for delaying a small period of time (about a few seconds) to perform the document feeding step S14 after the checking step S15 is accomplished.

Thus, the document may stably stays in the action field of the document feeding rollers, and may then start to proceed the document feeding action, thereby preventing incurring unnecessary actions before the document is fed into the document feeding roller.

It is appreciated that, in the detection method in accordance with the preferred embodiment of the present invention, if the checking step S15 checks that only a part of the sensors is triggered, it indicates that the document is disposed at a tilted state, or the placing document width is greater than the document width. At this time, the placement state of the document cannot achieve the condition of performing the step S14, so that the document feeding roller cannot be rotated.

The document cannot be fed automatically under the above-mentioned condition. Thus, the user has to adjust the angle of placing the document, or adjust the placing document width of the document feeding device, so that the document may be exactly received in the placing document width of the document feeding device, and may maintain the document feeding angle without tilting. Thus, the leading edge of the document may exactly trigger all of the sensors, thereby preventing the document from being tilted or jammed during the automatic document feeding process.

Figure 3:
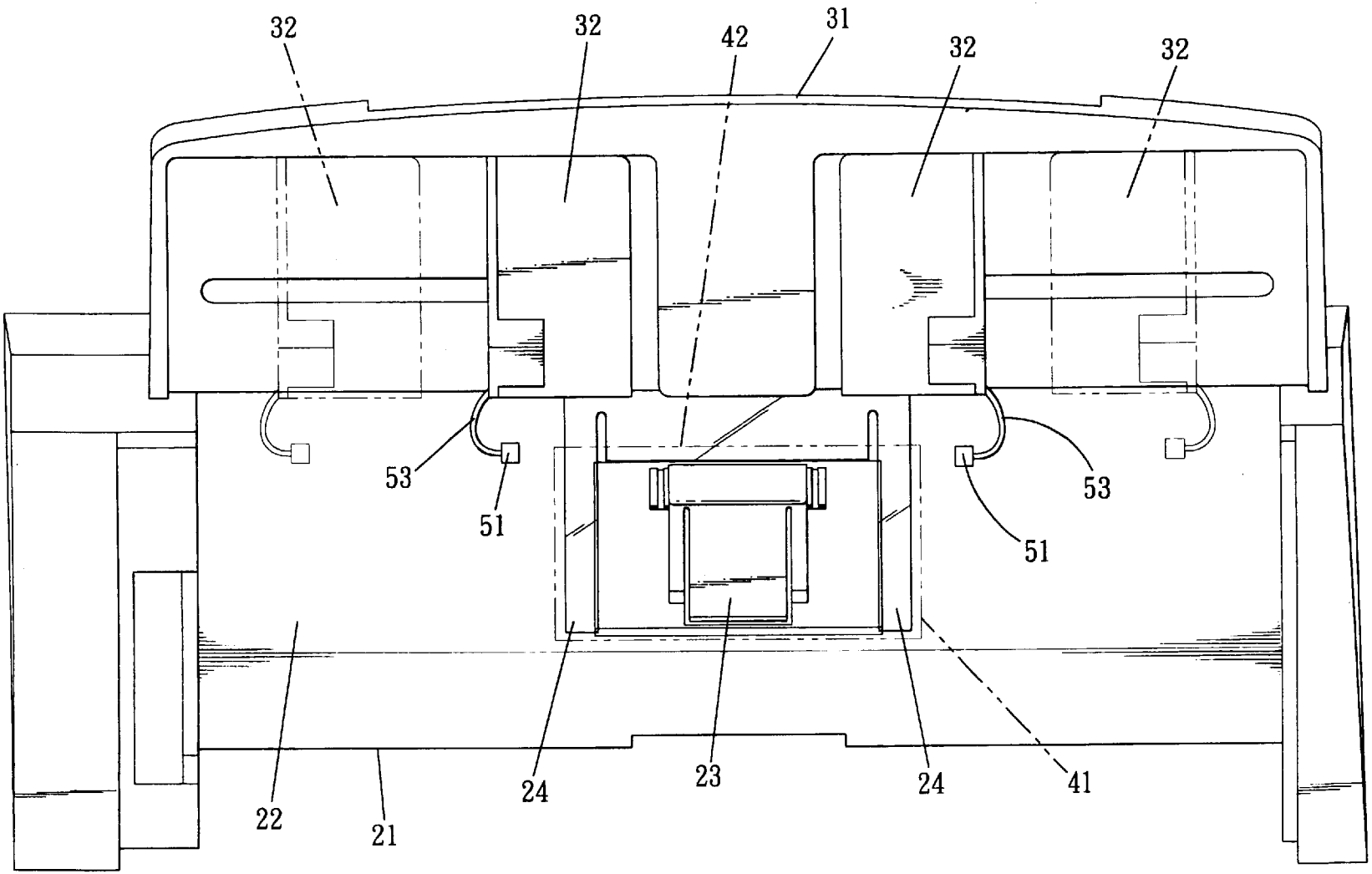
FIG. 3 is a schematic plan view of a detection device in accordance with a preferred embodiment of the present invention.

FIG. 3 is a schematic plan view of a detection device in accordance with a preferred embodiment of the present invention. The detection device in accordance with the preferred embodiment of the present invention includes a document feeder 21, a document guide plate 31, a document feeding roller 41, and at least two sensors 51.

The document feeder 21 has a surface 22, and the surface 22 is provided with a friction pad 23. In addition, the friction pad 23 has two sides each provided with a flexible document guide plate 24. The flexible document guide plate 24 is an individual elongated thin plastic plate, or an elongated plate at each of the two sides of an inverted U-shaped thin plastic plate.

The document guide plate 31 is provided with two movable racks 32 that may be moved relatively to approach or apart from each other. The distance between the two movable racks 32 is defined as the placing document width.

The document feeding roller 41 is mounted on the document feeder 21, and is opposite to the friction pad 23. As shown in the figure, the document feeding roller 41 and the friction pad 23 are opposite to each other in an up/down manner. The document feeding roller 41 has a leading edge 42 located adjacent to the document guide plate 31.

Each of the two sensors 51 may be a microswitch or a light sensor. Each of the two sensors 51 is secured on each of the two movable racks 32 by a link 53. Thus, each of the two sensors 51 may be moved with each of the two movable racks 32. It is appreciated that, each of the two sensors 51 is in parallel with the tangential direction of the leading edge 42 of the document feeding roller 41. The arrangement manner of the link 53 may be inclined with 45 degrees from up to down. Thus, when adjusting the document width, the mechanism travel will not interfere with proceeding of the detection, thereby obtaining the optimum effect.

Figure 4:
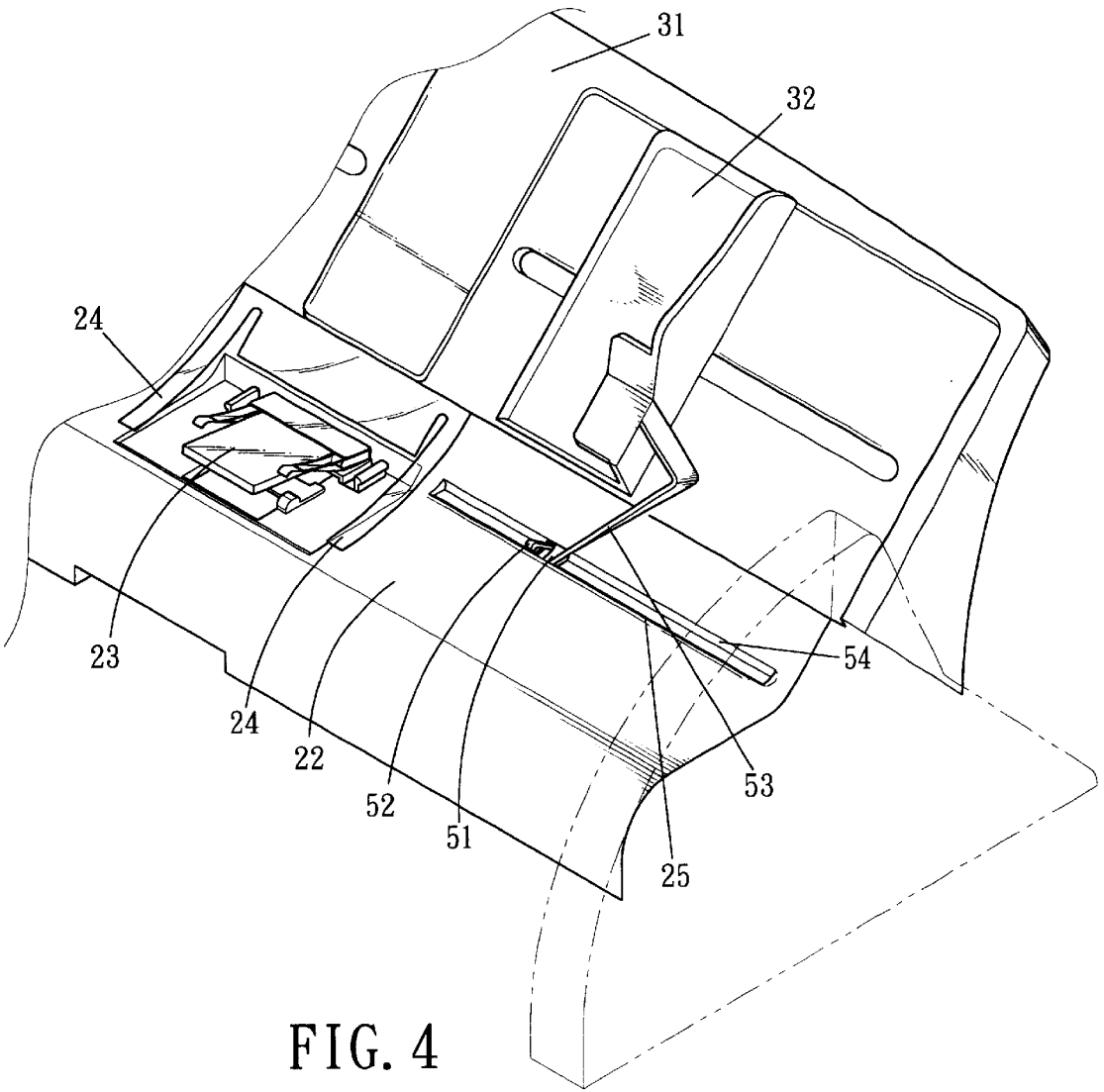
FIG. 4 is a locally pictorial view of a structure in accordance with a preferred embodiment of the present invention.
Figure 5:
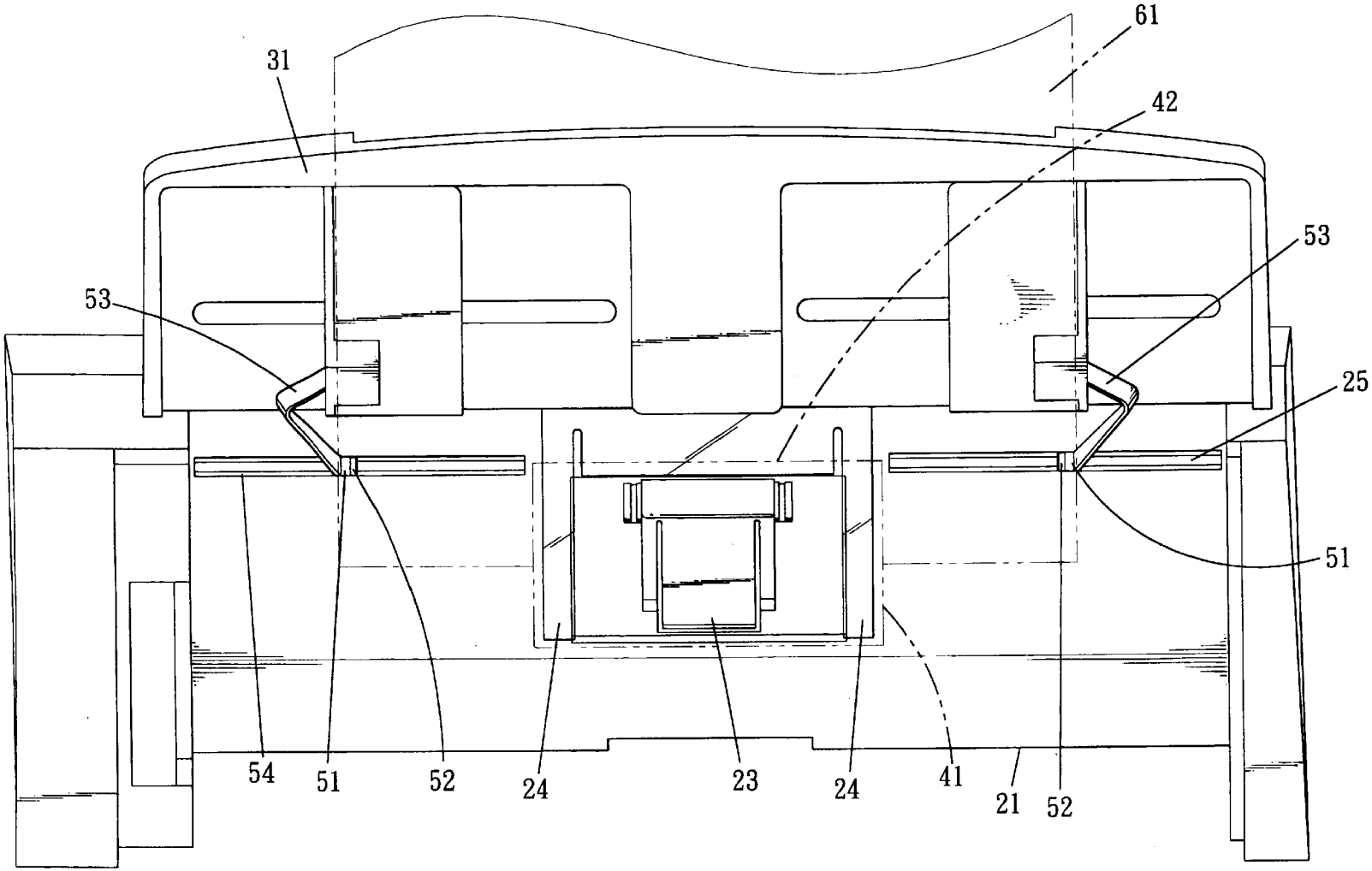
FIG. 5 is a schematic plan view of a usage state of FIG. 4.

FIG. 4 is a locally pictorial view of a structure in accordance With a preferred embodiment of the present invention, and FIG. 5 is a schematic plan view of a usage state of FIG. 4. As shown in the figures, the sensor 51 is a microswitch. The sensor 51 has a trigger rod 52 and has a determined thickness. Thus, the surface 22 is formed with a slide slot 25 to function as a mounting and moving space of the sensor 51, so that the sensor 51 may slide along the slide slot 25.

Thus, when the document 61 slides from the document guide plate 31 toward the document feeder 21, the document 61 may be supported and guided by the flexible document guide plate 24, and the two sides of the document 61 may exactly slide to locate above the sensor 51. Thus, the document 61 will not fall into the slide slot 25. Thus, the document 61 may press the trigger rods 52 on the two sensors 51, and may enter between the document feeding roller 41 and the friction pad 23 conveniently.

In design, for ensuring that the document 61 will not fall into the slide slot 25, the two side walls of the slide slot 25 may be made into concave faces 54 (or convex faces), thereby facilitating the document 61 sliding out of the slide slot 25 conveniently.

Each of the two sensors 51 is in parallel with the tangential direction of the leading edge 42 of the document feeding roller 41, and the document 61 may press the trigger rods 52 on the two sensors 51, so that the document 61 presents an non-tilting angle relative to the document feeding roller 41.

The document 61 may press the two trigger rods 52 to trigger the two sensors 51, thereby forming a necessary condition of driving the document feeding roller 41 to rotate. Thus, in the present embodiment, the document 61 may be placed without tilting, thereby ensuring that the document feeding angle is correct.

If at least one of the two sensors 51 is not triggered, the document feeding roller 41 will not be rotated, until the user adjust the angle of the document 61 or the placing document width, so that the document 61 may trigger the two sensors 51, to rotate the document feeding roller 41.

Figure 6:
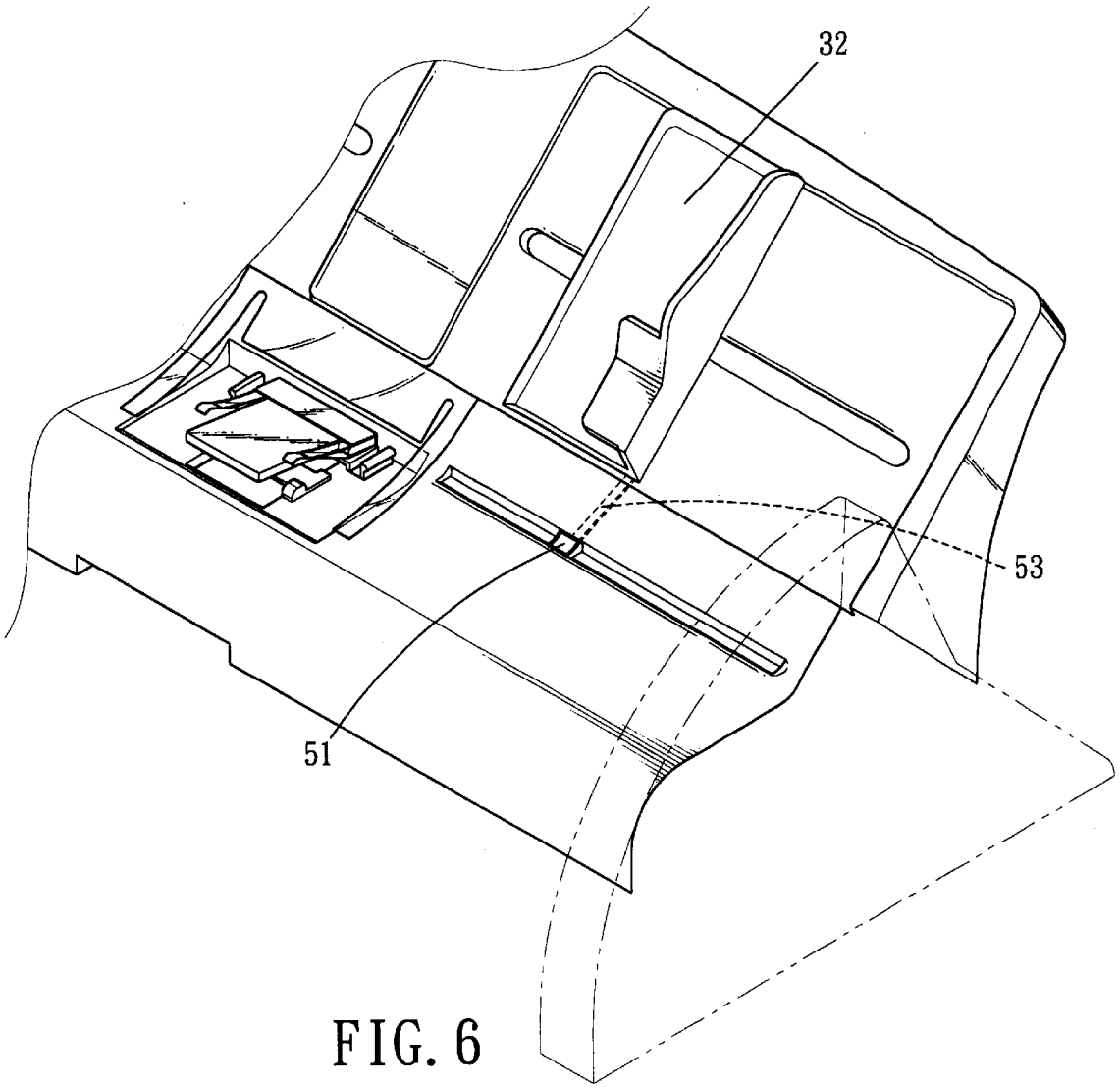
FIG. 6 is a locally pictorial view of another structure in accordance with a preferred embodiment of the present invention.
Figure 7:
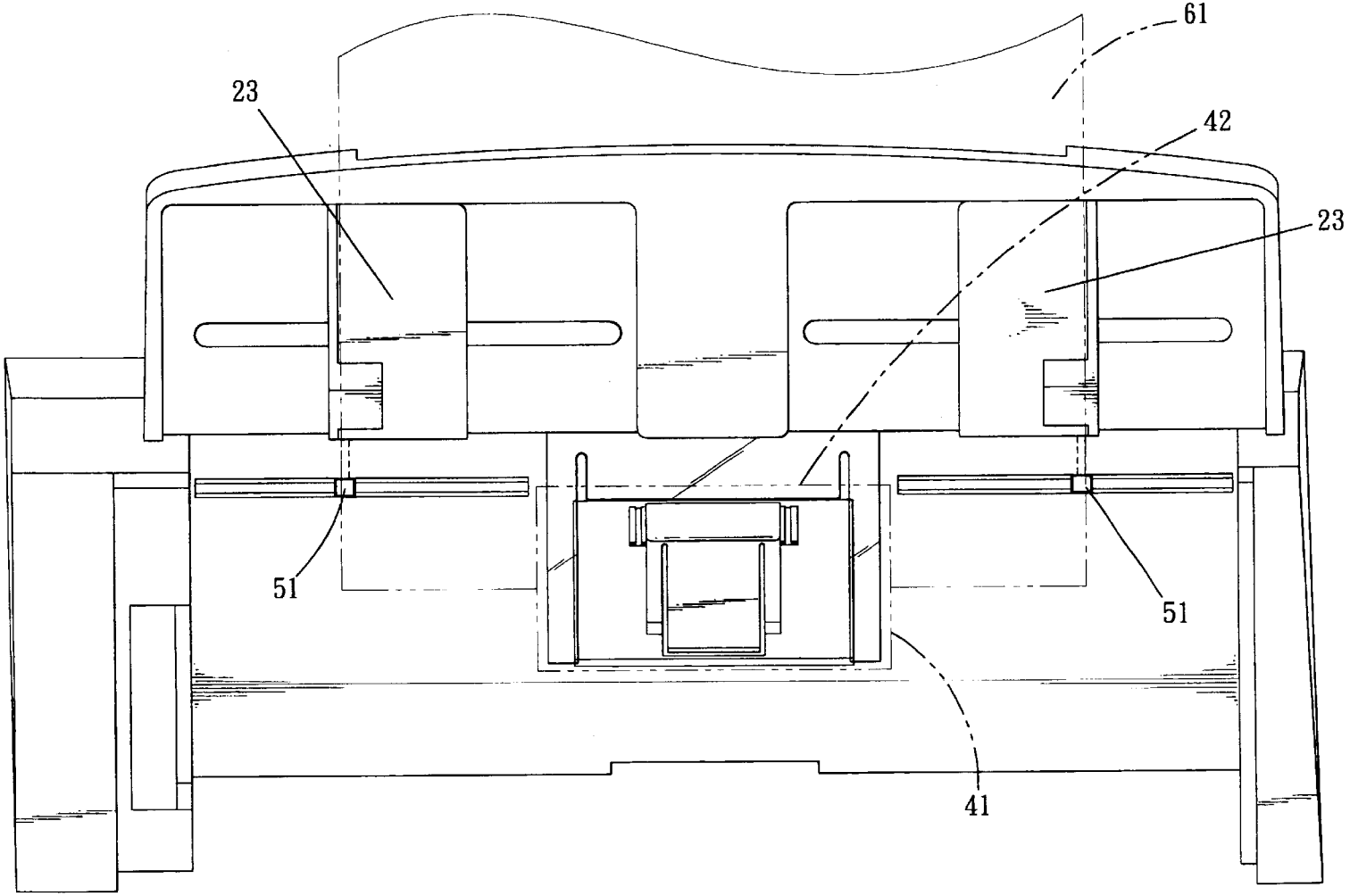
FIG. 7 is a schematic plan view of a usage state of FIG. 6.

FIG. 6 is a locally pictorial view of another structure in accordance with a preferred embodiment of the present invention, and FIG. 7 is a schematic plan view of a usage state of FIG. 6. As shown in the figures, the sensor 51 is a light sensor. The sensor (light sensor) 51 may use the light shutdown effect to achieve the switch (on/off) action.

The two sensors 51 are in parallel with the tangential direction of the leading edge 42 of the document feeding roller 41, and may be moved with the two movable racks 32. The usage state of the present embodiment is the same as that of the previous embodiment. The two sensors 51 are used to detect the placing angle of the document 61, and the triggering situation of the two sensors 51 is used as the condition of driving the document feeding roller 41.

In the present invention, the two sensors 51 may be moved with the two movable racks 32, and each of the two sensors 51 is in parallel with the tangential direction of the leading edge 42 of the document feeding roller 41. Thus, the present invention has the effect of exactly detecting the placing angle of the document 61. The detected placing angle of the document 61 may function as the condition of driving the document feeding roller 41. Thus, the present invention may ensure the document feeding roller 41 not to misact, thereby preventing the document from being tilted or jammed.

While the preferred embodiments of the present invention have been shown and described, it will be apparent to those skilled in the art that various modifications may be made in the embodiments without departing from the spirit of the present invention. Such modifications are all within the scope of the present invention.

What is claimed is:

1. A device for detecting a placement position of a document, comprising:

a document feeder having at least two slide slots defined in a surface thereof;

a document guide plate mounted on one side of the document feeder and having two movable racks that are capable of moving relative to each other;

a document feeding roller mounted on the document feeder and having a leading edge located adjacent to one side of the document guide plate; and at least two sensors each respectively connected to each of the two movable racks of the document guide plate, the at least two sensors being movable engaged in the slide slots of the document feeder, each of the sensors being in parallel with a tangential direction of the leading edge of the document feeding roller.

2. The device for detecting a placement position of a document in accordance with claim 1, wherein the sensor is a microswitch.

3. The device for detecting a placement position of a document in accordance with claim 1, wherein the sensor is a light sensor.

4. The device for detecting a placement position of a document in accordance with claim 1, wherein the document feeder comprises a friction pad opposite to the document feeding roller.

5. The device for detecting a placement position of a document in accordance with claim 1 wherein the slide slot has a wall formed with a concave face.

6. The device for detecting a placement position of a document in accordance with claim 1 wherein the slide slot has a wall formed with a convex face.

* * * * *